US006089724A

United States Patent [19]

Shore et al.

[11] Patent Number: 6,089,724

[45] Date of Patent: Jul. 18, 2000

[54] INDIRECT TASK LIGHT MONITORS AND THE LIKE

[75] Inventors: Edward L. Shore, Warwick; Jeffrey M. Jacober, Providence, both of R.I.

[73] Assignee: One Tech LLC, Providence, R.I.

[21] Appl. No.: 09/184,570

[22] Filed: Nov. 2, 1998

[51] Int. Cl.[7] ..... F21V 1/14; F21V 33/00

[52] U.S. Cl. ..... 362/85; 362/33; 362/253; 362/359

[58] Field of Search ..... 362/30, 33, 85, 362/127, 133, 134, 253, 298, 359; 348/842

[56] References Cited

U.S. PATENT DOCUMENTS

| | | | |
|---|---|---|---|
| 1,389,013 | 8/1921 | Schwartz | 362/269 |
| 1,489,341 | 4/1924 | Boyd et al. | 362/298 |
| 1,554,427 | 9/1925 | Englen | 362/283 |
| 1,598,106 | 8/1926 | Schoonmaker | 362/283 |
| 2,075,367 | 3/1937 | Smithburn | 362/283 |
| 2,082,687 | 6/1937 | Davis | 362/298 |
| 2,669,708 | 2/1954 | Du Mont | 362/127 |
| 3,970,274 | 7/1976 | Resk | 248/185 |
| 4,337,506 | 6/1982 | Terada | 362/298 |
| 4,414,609 | 11/1983 | Shemitz | 362/33 |
| 4,489,366 | 12/1984 | Rozniecki | 362/270 |
| 4,626,965 | 12/1986 | Gupta et al. | 362/33 |
| 4,760,277 | 7/1988 | Vurpillat | 362/33 |
| 4,922,060 | 5/1990 | McJunkin | 178/18 |
| 5,115,384 | 5/1992 | Loth et al. | 362/301 |
| 5,320,318 | 6/1994 | Chen | 248/286 |
| 5,322,255 | 6/1994 | Garrett | 248/299 |
| 5,372,347 | 12/1994 | Minnich | 248/371 |
| 5,485,359 | 1/1996 | Galvin | 362/109 |
| 5,530,628 | 6/1996 | Ngai | 362/33 |
| 5,655,833 | 8/1997 | Raczynski | 362/419 |
| 5,687,945 | 11/1997 | Lee | 248/442.2 |
| 5,722,754 | 3/1998 | Langner | 362/1 |

FOREIGN PATENT DOCUMENTS

| | | | |
|---|---|---|---|
| 6408605 | 1/1966 | Netherlands | 362/133 |

*Primary Examiner*—Alan Cariaso
*Attorney, Agent, or Firm*—Cook, Alex, McFarron, Manzo, Cummings & Mehler, Ltd.

[57] ABSTRACT

Task light units provide indirect lighting for task areas in front of computer monitors and other devices having display screens. Light is directed generally upwardly such that at least a portion of the light impinges upon a visor which is generally above the source of light. The visor reflects the light downwardly and generally forwardly toward a work or task area in order to indirectly illuminate that area. The task light components do not impart any direct light onto the display screen. Glare emanating from the task light is avoided, and eye strain is significantly reduced.

40 Claims, 8 Drawing Sheets

FIG. 4
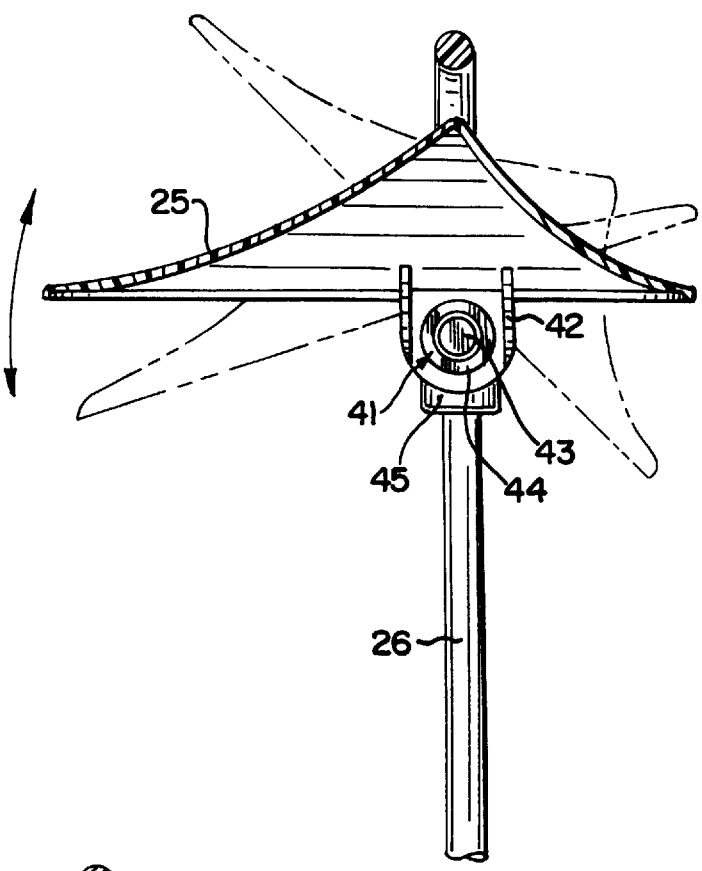
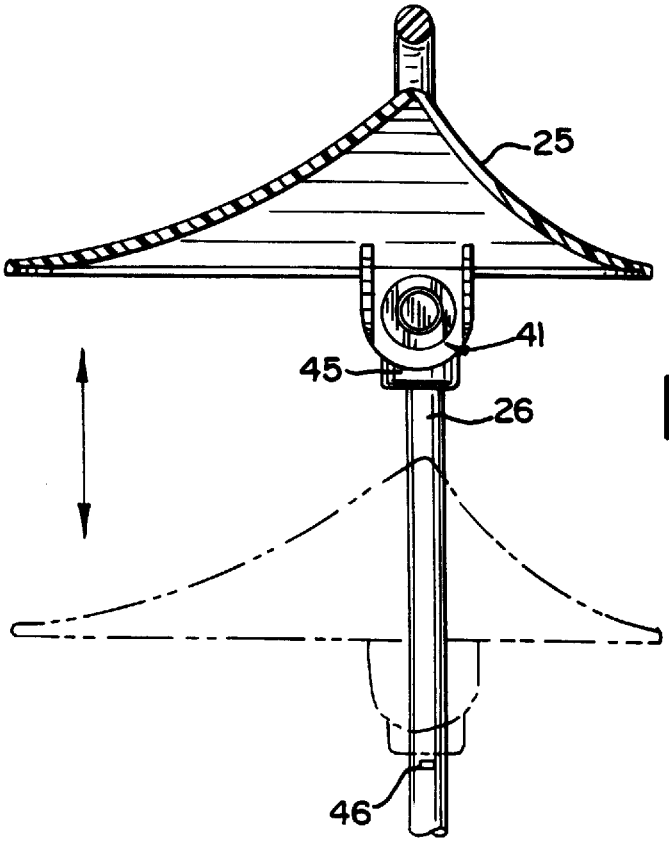
FIG. 5

25
62
64
63
66
26
51
52
58
57
24
38
61
34
35
33
31
36
32
37

INDIRECT TASK LIGHT MONITORS AND THE LIKE

BACKGROUND OF THE INVENTION

This invention generally relates to a light for illuminating a task area, more particularly to a light which illuminates a task area by using indirect lighting which addresses eye strain concerns. The light is especially suitable to be mounted onto or positioned within the casing of a monitor of computer equipment with the objective of substantially reducing glare onto the display screen of the monitor, typically while providing beneficial indirect lighting for the task area being illuminated.

In the past, task lighting devices of various types have been provided or proposed for lighting task areas, while being directed toward reducing reflected glare. Some of them are intended to provide direct illumination of computer monitor display screens. For example, U.S. Pat. No. 5,722,754 attempts to ease eye strain by providing auxiliary lighting of a computer monitor display screen by illuminating it with simulated natural daylight from full spectrum bulbs. The display screen is intentionally and directly illuminated by the full spectrum illumination source.

Another type of task lighting is illustrated in U.S. Pat. No. 5,655,833, which provides a slidably mounted lighting fixture secured to the side panel of a computer monitor. This lighting fixture is designed to provide work surface illumination on a surface adjacent to a computer monitor and without unnecessarily increasing ambient room lighting. Another approach is proposed by U.S. Pat. No. 5,530,628, which shows a task light for use with office furniture systems having a backwall which is illuminated by the task light.

Task lighting fixtures of these general types light a task area or a monitor display. They do not concentrate upon lighting a task area which is in front of a display screen such as that of a computer monitor. None suggest the use of indirect lighting to achieve this type of task lighting. Relatively recent studies and observations have recognized a condition which has come to be known as Computer Vision Syndrome (or CVS), which is a repetitive stress injury, believed to be caused by the act of refocusing on a computer screen image again and again. Most users of computer monitors or other equipment incorporating self-illuminating display screens and the like are susceptible to suffering eyestrain. Symptoms of CVS include headaches, blurred vision and dry eyes.

CVS development typically is associated with decreasing of the blink reflex. Blinking can be reduced to an unnatural frequency when one stares into a computer monitor. An average person blinks twenty-two times per minute. During reading sharp black letters on white background, the rate decreases to twelve times per minute. At the computer, the blink reflex rate is reduced to only four times per minute. Such reduced blinking increases tear evaporation, resulting in a substantial increase in the exposure of the corneas. The result is dryer, more irritated eyes.

Unlike printed type which presents sharp edges in order to accurately interpret and maintain focus, users of display screens and computer monitors must focus and refocus involuntarily in an attempt to keep the images sharp. This is due in large part to the fact that display screens comprise pixels (minute subdivisions) which are very difficult for the human eye to keep in focus. Repetitive stress of the eye muscles results as the plane of focus drifts out to a resting point of accommodation. It is presently believed that this accommodation phenomenon is instrumental in the decreased blinking rate associated with computer use.

Glare from and at the workspace is a significant contributor to CVS. Ambient light which falls across a display screen has a lightening effect, decreasing contrast sharpness. Because of this uniform glare, eyes are strained in order to see and discern the characters appearing on the display screen. Another aspect of reflective glare involves objects which can be seen on the screen in addition to the screen image. So-called veiling reflections require the eyes to continuously filter out the reflected image from the screen image. On the whole, reflective glare is generated by light sources outside of the screen, such as behind, above or next to the operator. Needless illumination is bounced onto the monitor, and the light from these unexpected sources enhances the likelihood that CVS will result.

It has been determined that eye strain generally associated with CVs, and the associated symptoms such as burning or tired eyes, blurred vision, loss of focus and headaches, can be significantly reduced by systems of the present invention which incorporate indirect lighting for illuminating a task area. When properly utilized, indirect lighting minimizes both direct glare and reflective glare on the video display tube. Uniform glare and veiling reflections issues are significantly controlled. By reducing the external illumination of the display screen while still adequately lighting the task area, eye strain symptoms are reduced, and blinking frequency rates are more naturally increased.

SUMMARY OF THE INVENTION

In accordance with the present invention, task lighting is provided which does not produce glare, but instead creates a reflected glow of indirect lighting of the immediate workspace. More particularly, an indirect task light is provided for monitors, video display tubes, and the like. The task light system incorporates a source of light which is directed upwardly toward a visor member which receives light rays from the light source. A reflective surface of this visor member reflects the light rays generally downwardly in a ray pattern which avoids any substantial direct illumination of the display screen by these light rays. Generally speaking, the light rays are reflected in an array which defines an illumination pathway having rays which are generally parallel to the display screen, as well as rays which extend away from the computer screen when viewed in a downward direction. No rays are directed toward the screen by the system.

It is accordingly a general object of the present invention to provide an improved indirect illumination task light for computer monitors, video display tubes, display screens and the like.

Another object of the present invention is to provide an improved task light which shines only reflected, indirect light onto a task area positioned generally in front of a monitor display screen and the like.

Another object of this invention is to provide an improved task light which results in increased blinking frequency of the eyes of a user of equipment such as a computer having a display screen which is viewed for long periods of time by the user.

Another object of the present invention is to provide task lights which successfully address eye strain concerns often associated with Computer Vision Syndrome.

Another object of this invention is to provide an integral component of a work station which provides task lighting that does not produce glare on a display screen at a task area location.

Another object of the present invention is to provide an improved task light system which is easily mountable onto the top panel of a computer monitor or the like and which indirectly lights a task area in front of the monitor.

Another object of the present invention is to provide an improved task light system which is incorporated within the casing of a computer monitor, video display tube or the like and that provides indirect illumination of a task area in front of the monitor.

Another object of the invention is to provide a task light system which avoids directly illuminating the display screen at the workstation.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein:

FIG. 4 is a cross-sectional view of a shade or visor member as generally shown in FIG. 1, illustrating pivoting movement thereof;

FIG. 5 is a cross-sectional view of a shade or visor member as generally shown in FIG. 1, illustrating sliding vertical movement thereof;

DESCRIPTION OF THE PREFERRED EMBODIMENTS

Figure 1:
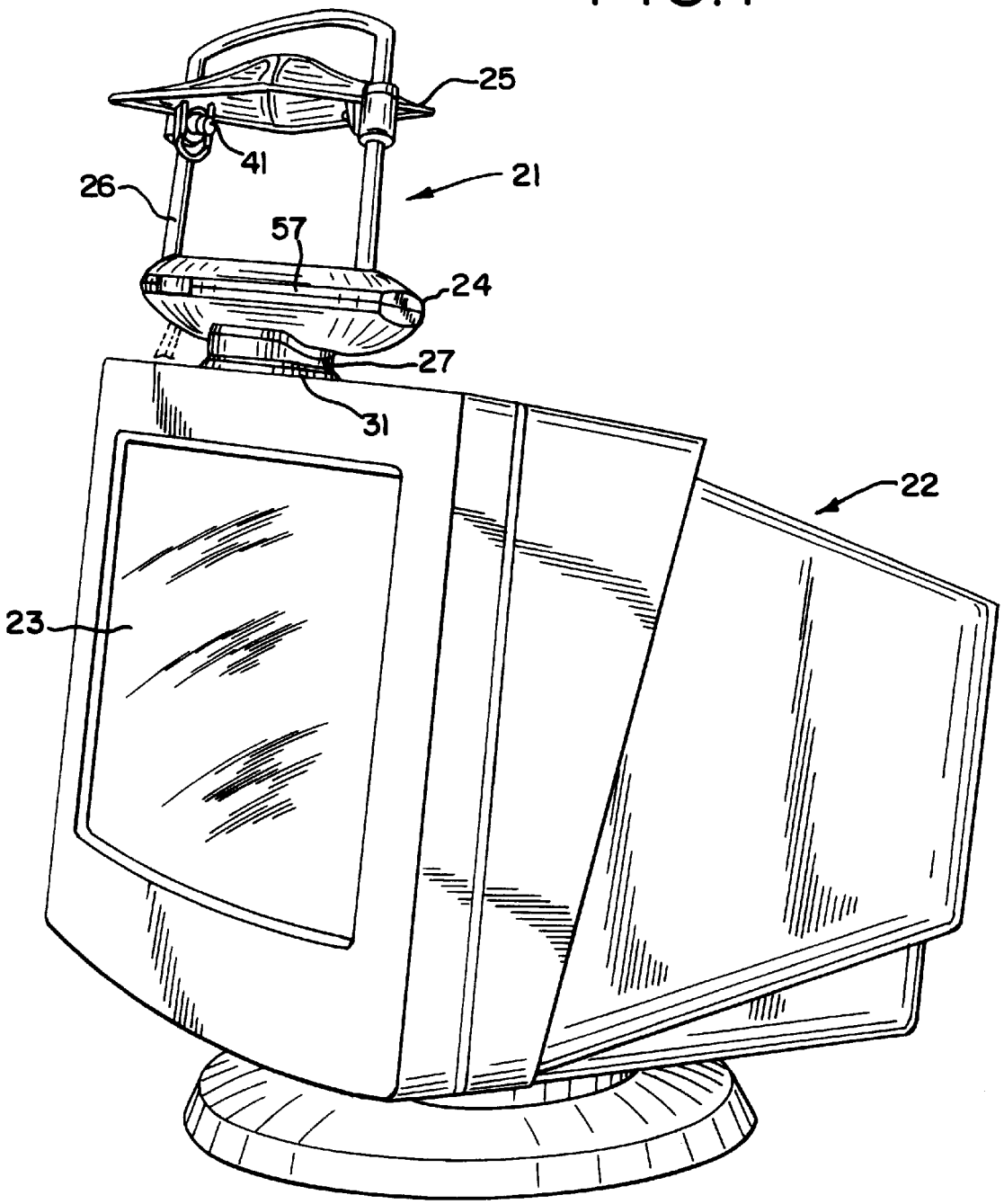
FIG. 1 is a perspective view of an embodiment of a task light according to the invention, shown in combination with a computer monitor.

An embodiment of a task light according to the invention is generally illustrated at 21 in FIG. 1. Task light 21 is shown mounted on, and in combination with, a computer monitor, generally designated at 22. A detailed description of the monitors illustrated herein is not provided in view of the general knowledge of such devices to those of ordinary skill in the art. Monitor 22 is also intended to illustrate any other devices having a video display tube having a screen such as the display screen 23 which is illustrated.

Task light 21 includes a base assembly 24 and a shade or visor member 25 suspended above the base assembly by a frame unit 26. Also included in this illustrated embodiment is a bracket assembly 27. Other suitable suspensions and assemblies can take forms other than those explicitly illustrated in the drawings.

Referring more specifically to the illustrated bracket assembly 27, this has an adjustability feature which is useful in accommodating the task light 21 to a variety of different monitors. For example, each of monitor 22 of FIG. 1 and 22*a* of FIG. 2 have a generally horizontal top surface. With these types of monitors, the bracket assembly is typically adjusted such that bottom surface 31 of the bracket assembly 27 is generally horizontal and substantially perpendicular to the frame unit 26 when viewed from the side as in FIG. 2 and FIG. 6.

Figure 3:
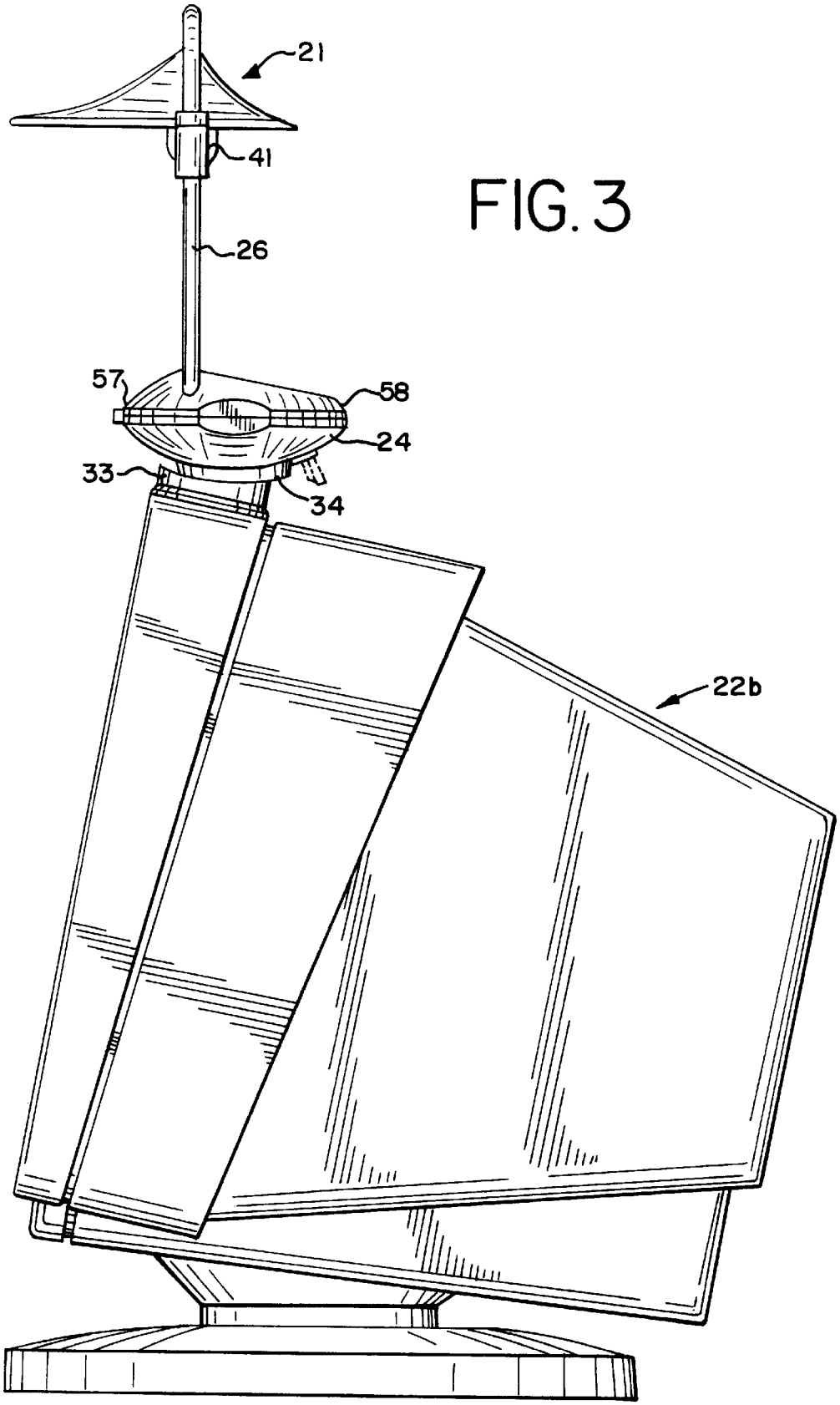
FIG. 3 is a side elevational view of a task light as generally shown in FIG. 1 in combination with a different embodiment of computer monitor.
Figure 6:
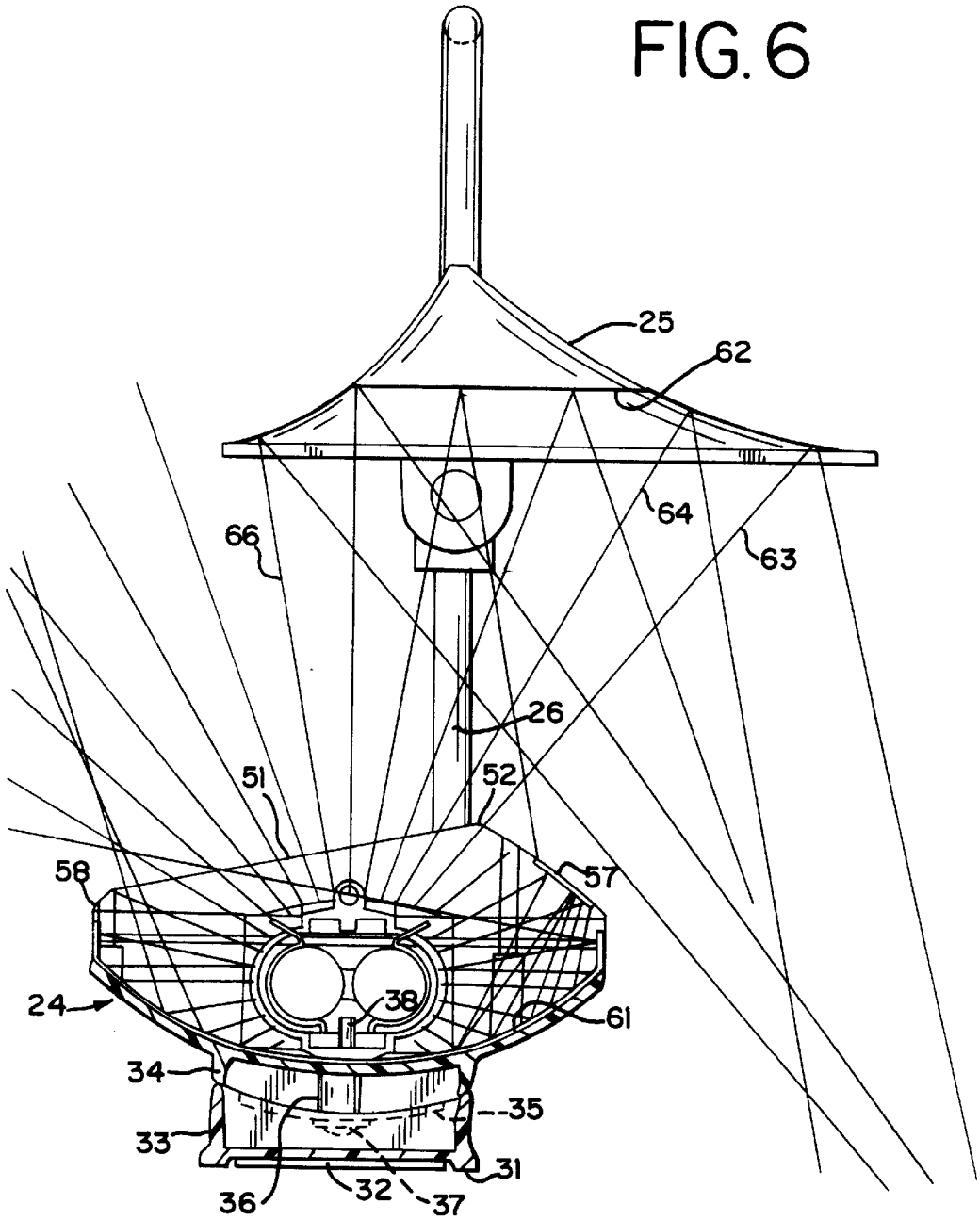
FIG. 6 is a generally schematic detail view of the task light as generally shown in FIG. 1.

With further reference to FIG. 6, bottom surface 31 includes an indent within which is positioned a mounting member such as illustrated double-sided tape 32. Such mounting member securely fastens the base assembly 24 and thus the task light to an upper surface of the monitor. As can be generally seen in FIG. 3 and in FIG. 6, the base assembly is adjustable such that the bottom surface 31 is not perpendicular, but instead is angularly offset with respect to, the frame unit 26, as can be seen in FIG. 3.

In the illustrated embodiment, a bottom bracket 33 is slidably secured along an arcuate path with respect to a bottom boss 34. A suitable securement assembly holds the arcuate position of the bottom bracket 33 which is selected with respect to the bottom boss 34. The illustrated securement assembly includes a bracket 35, a sleeve 36, a screw 37, and a threaded cap 38 for receiving and holding the bolt. Once the bolt is loosened, the bottom bracket 33 can be swung to the position desired, after which the assembly is tightened down in place.

FIG. 4 illustrates the tiltability of the visor member 25 by virtue of its being rotatably mounted with respect to the frame unit 26. Any suitable pivot mounting assembly which will accommodate desired tilting of the visor member 25 can be utilized. Illustrated pivot 41 supports the shade by downwardly depending ears 42, which receive a pivot shaft 43 projecting from a projecting mount 44 of a bushing 45. This feature allows the user to adjust the ray pattern developed by the inside surface of the visor member 25 as it reflects light emanating from the base assembly 24, as generally discussed herein. This permits adjustment for accommodating the needs of different users, such as user height, and height and placement of task areas and seating devices.

FIG. 5 illustrates vertical adjustment which is available in accordance with this embodiment. Each bushing 45 is mounted along each vertical length of the frame unit 26. In order to prevent visor member 25 from moving too close to the light source within the base assembly 24, a stop 46 is preferably included.

With further reference to the base assembly 24, a lens 51 is provided over a light-passing opening 52 within a casing 53. As illustrated, vents 54, 55 can be included for dissipating heat out of the base assembly. Typically, the lens 51 will be substantially transparent so that light emanating from light source 56 will pass out of the casing 53 through the light-passing opening 52.

Figure 10:
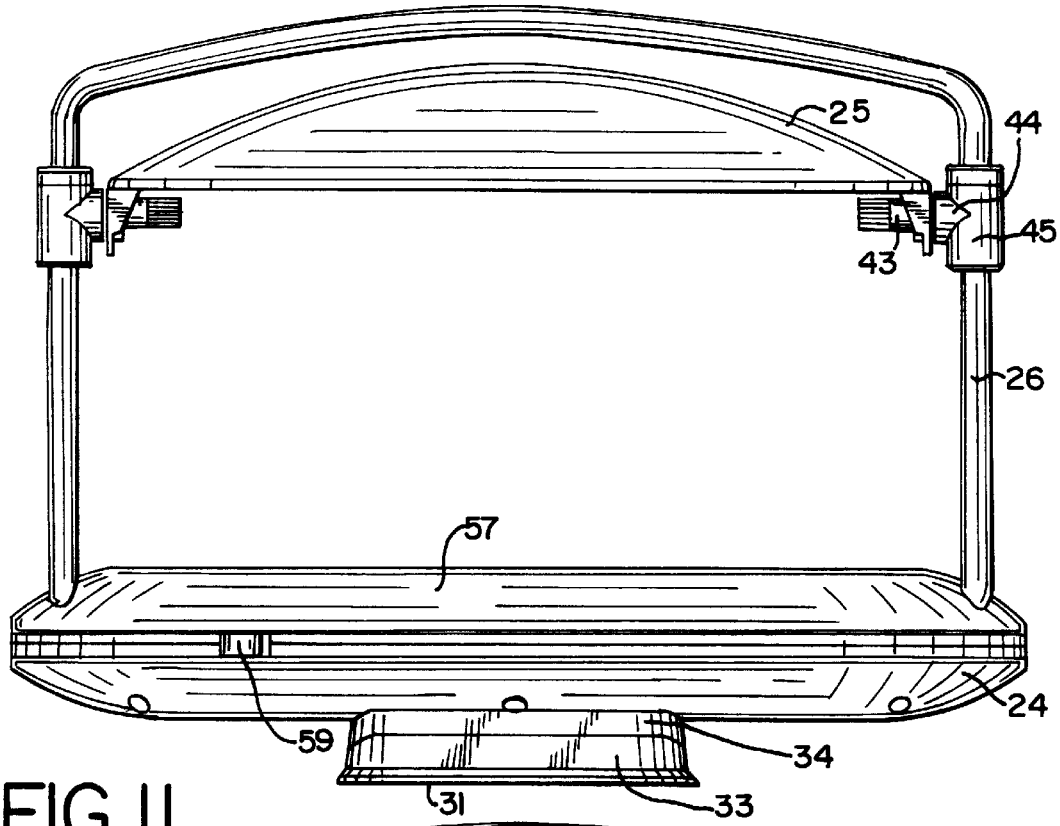
FIG. 10 is a front elevational view of the task light of FIG. 1.
Figure 11:
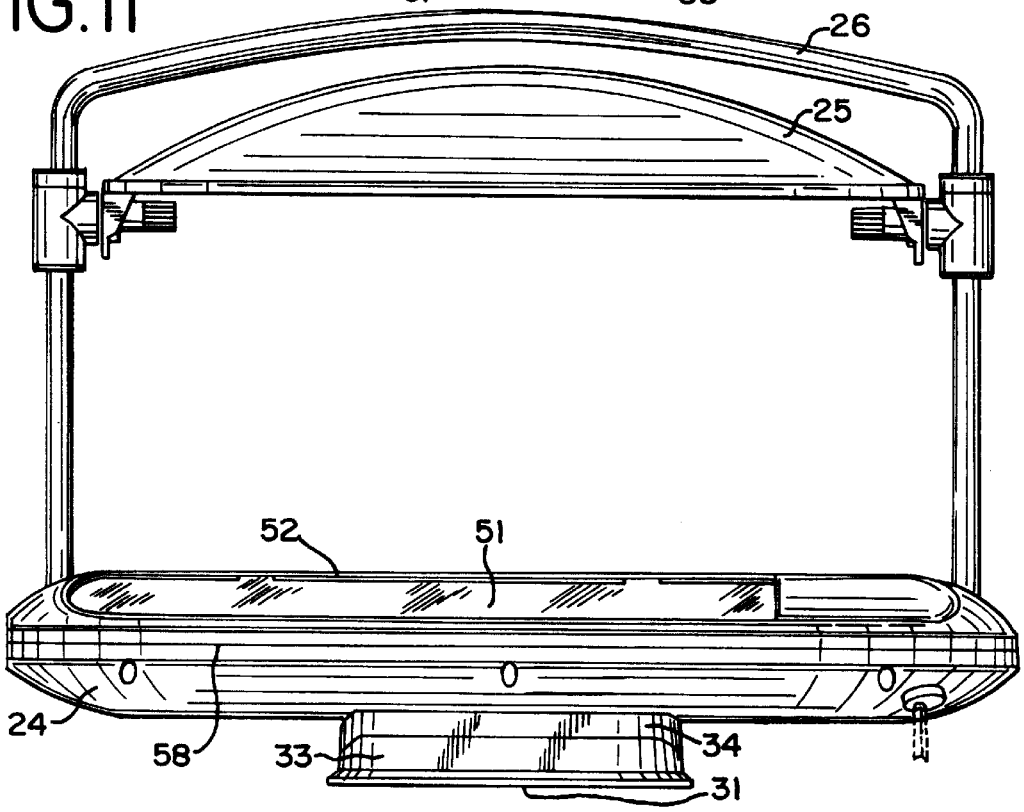
FIG. 11 is a rear elevational view of the task light of FIG. 1.

It will be noted that the front portion 57 of casing 53 has a height greater than rear portion 58 of the casing. As can be seen from various Figures, including FIG. 6, FIG. 10 and FIG. 11, this unsymmetrical construction results in the light-passing opening 52 being oriented generally rearwardly, as well as upwardly. Among other effects, this unsymmetrical top casing avoids unwanted direct illumination toward the front of the task light, while also shielding the user's eyes from light emanating directly from the opening 52.

Figure 2:
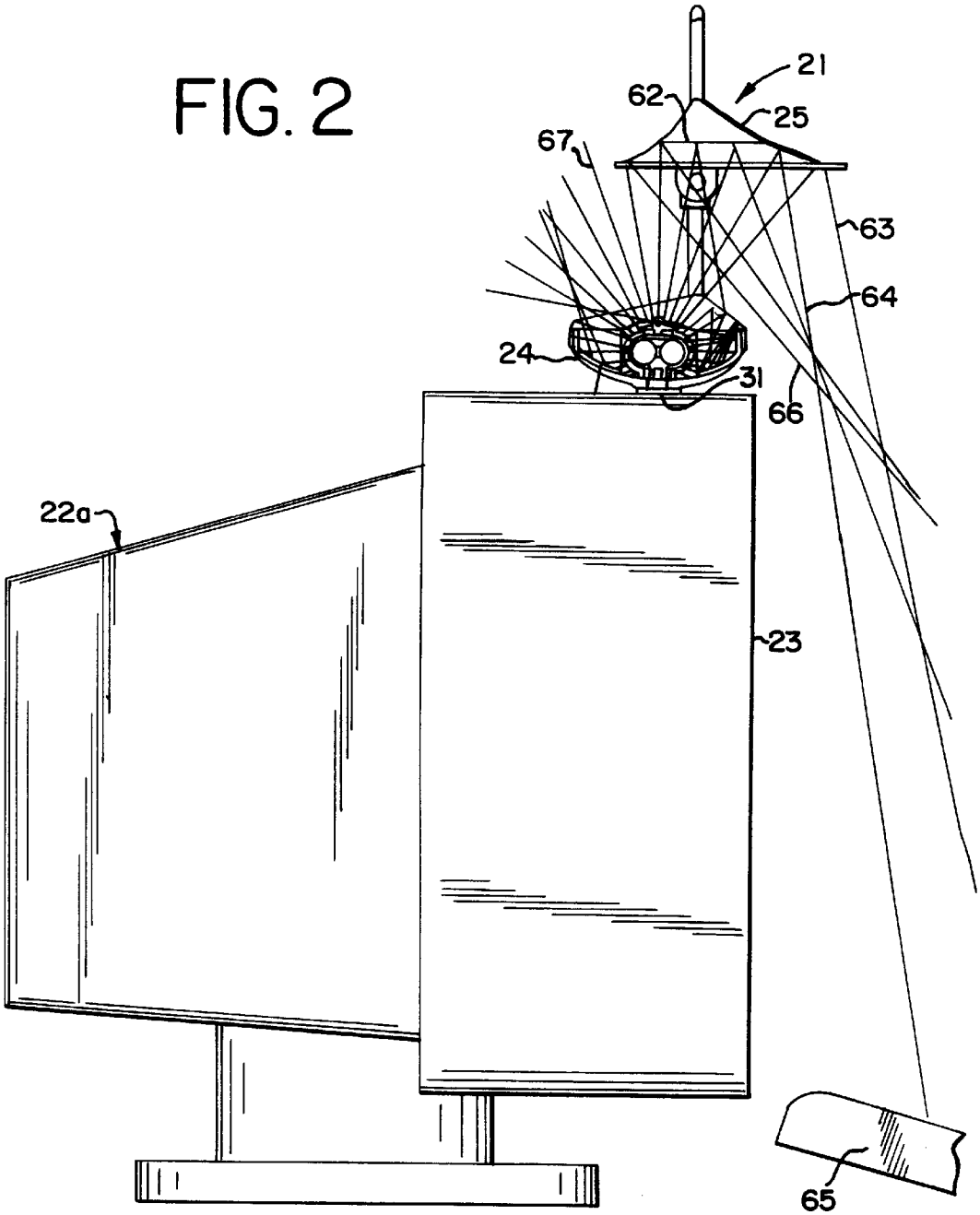
FIG. 2 is an elevational side view schematically illustrating certain aspects of the combination of FIG. 1.

Light source 56 can be any of a variety of sources. The illustrated one is a fluorescent source, controllable by off-on switch 59 or other suitable means. As schematically illustrated in FIG. 2 and in FIG. 6, some of the light rays from this light source 56 remain within the casing 53. Some of the light reflects off of a back or inside reflector 61.

Figure 7:
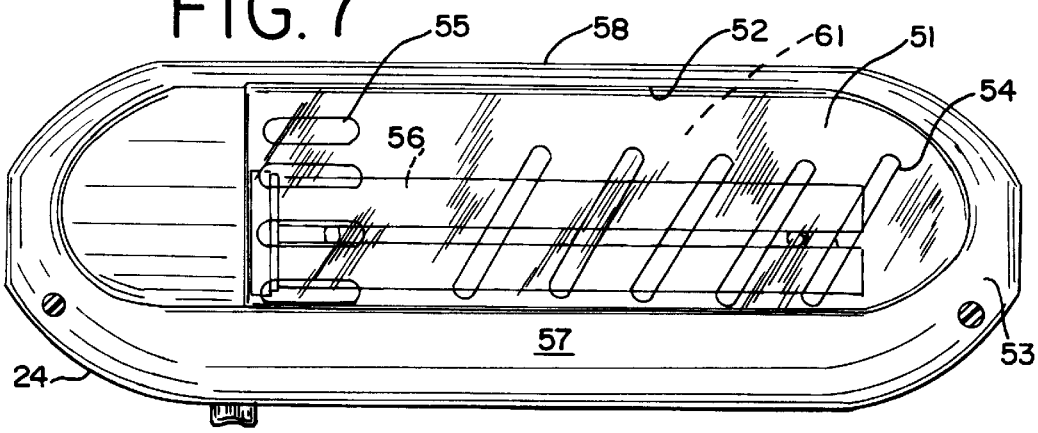
FIG. 7 is a top plan view of the task light of FIG. 1, shown with the visor assembly cut away.
Figure 8:
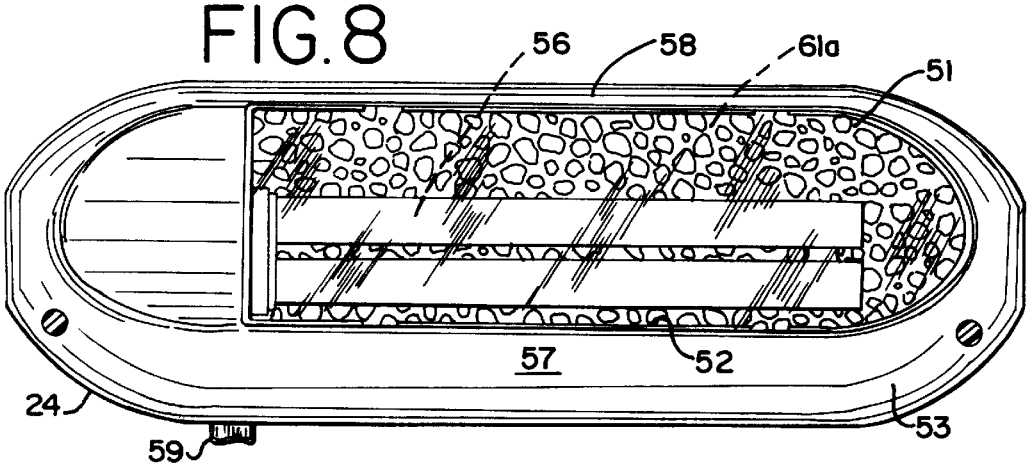
FIG. 8 is a top plan view as in FIG. 7, illustrating another embodiment of the lens and internal reflector of the base assembly.
Figure 9:
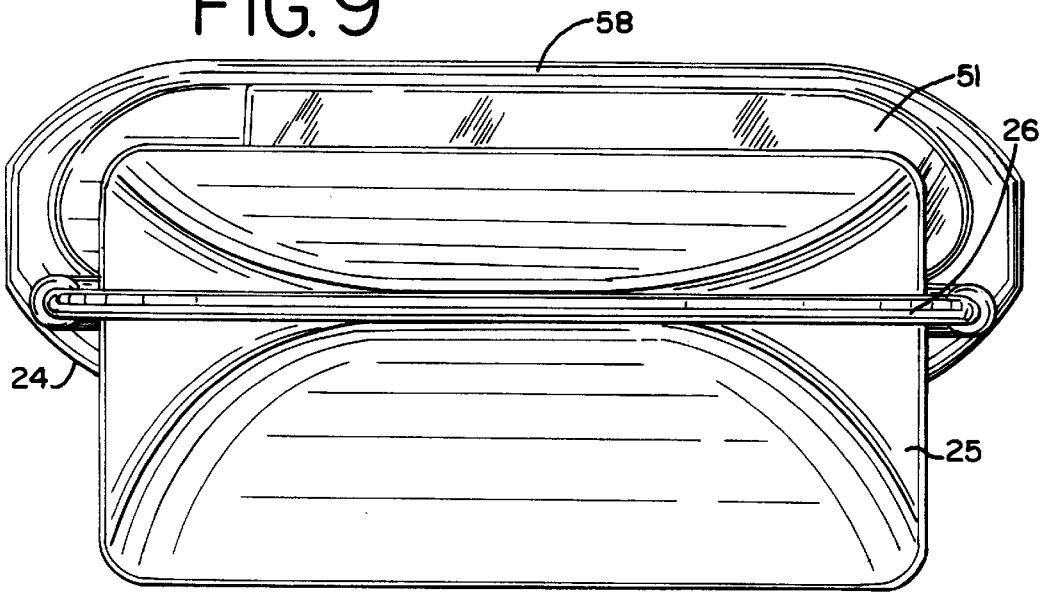
FIG. 9 is a top plan view of the task light of FIG. 1.

Back reflector illustrated in FIG. 7 has a generally smooth reflective surface, while reflector 61a of FIG. 8 has a rough or hammertone reflective surface. Another reflector or reflective surface can be provided within the visor member 25, as generally illustrated at 62 in FIG. 6. These reflectors can be made of reflective foil which is adhesively applied or plated by suitable means such as electroless deposition. Plated polymer reflector members can be made of polymers such as polycarbonate, polyurethane and the like, such as those exhibiting a mirror finish. A non-metallic polycarbonate reflector member having a composition as generally known to those skilled in the art can be utilized.

It will be appreciated that the visor 25 is functionally off center in the illustrated embodiment. In a general sense, this facilitates the indirect lighting effect provided by the invention at the task area in front of the display screen, while simultaneously permitting ambient light to emanate from the rear of the task light and of the computer work station. Both of these functions now are more specifically described, especially with reference to FIG. 2, FIG. 6 and FIG. 13.

Light rays which pass through opening 52 but not through the rest of the casing 53 are schematically illustrated. A forwardmost ray 63 reflects from visor reflector 62 in a direction which is generally vertical and generally parallel to display screen 23. Another illustrated ray 64 is somewhat more vertical after it leaves the visor member 25. A plurality of rays form the ray pattern which is generally illustrated lights a task area 65 extending in front of the monitor. A generally rearwardmost ray 66 which is reflected by the visor reflector 62 reflects the light within the generally downwardly oriented ray pattern, but at a less vertical angle than ray 64. These rays combine to form the illustrated light array which extends from a generally vertical orientation in front of the display screen 23 to an extent at which the ray pattern gradually increases forwardly in the downward direction. This light pattern has a rough overall appearance of a generally triangularly shaped column of light in front of the monitor and which illuminates the task area.

Light rays such as ray 67 do not impinge upon the visor member 25, but instead provide direct lighting toward the rear of the task light in order to provide ambient lighting. Ambient lighting can be beneficial in reducing eye strain by lessening the contrast between the display screen and the environment around the monitor, but in a way which does not cause reflective glare at the display screen 23.

Figure 13:
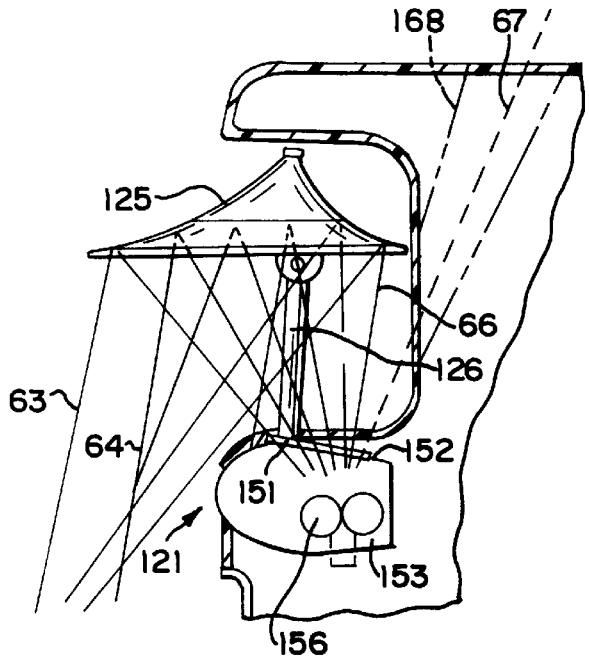
FIG. 13 is a cross-sectional view, partially broken away, along the top portion of the monitor of FIG. 12, further showing the task light in generally schematic elevation.
Figure 12:
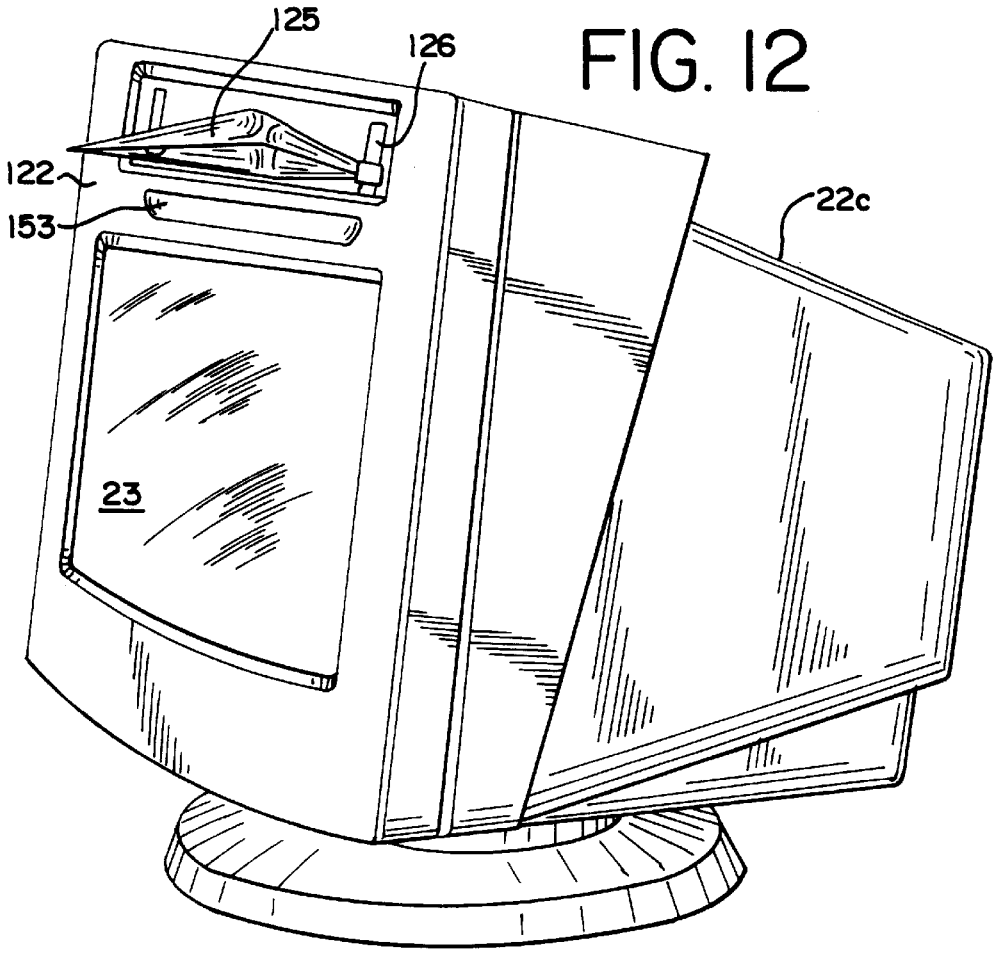
FIG. 12 is a perspective view illustrating a task light incorporated into the casing of a computer monitor.

Referring now to the embodiment illustrated in FIG. 12 and FIG. 13, the task light of this embodiment, generally designated 121, can have an overall structure similar to that of the previously discussed embodiments. It will be appreciated that other structures can be substituted. In this particular illustrated embodiment, the task light 121 is integrally positioned within an upper portion of case 122 of this monitor 22*c*. Light source 156 is shown positioned within the base 122, with light from it passing through opening 152 and through lens 151. A casing 153 is schematically illustrated. It will be appreciated that a suitable casing can be provided which is a more integral part of the monitor case 122, and this case 153 is provided for illustrative purposes to indicate how the basic concept of the invention can be implemented in a task light arrangement which is built into the monitor itself. Illustrated visor member 125 performs functions along the lines of those discussed elsewhere herein. Visor member 125 is illustrated as being adjustably supported along the frame unit 126 as generally discussed.

The embodiment illustrated in solid lines provides only the downwardly (and somewhat forwardly) directed ray pattern for illuminating the task area in front of the monitor 22*c*, as generally discussed elsewhere in connection with rays 63, 64 and 66. Illustrated in phantom is an ambient light passageway 168 which can be provided when it is desired to permit backlight, schematically illustrated by ray 67, from emanating out of the monitor in order to provide some ambient lighting.

Photometry tests were conducted which illustrate the effectiveness of the indirect task lighting achieved by the set up generally illustrated in FIG. 2. Light sensors were located in a patterned array so as to measure the quantity of light both on the screen of a computer monitor and the soft indirect light at the task area in front of the computer. A task light having a fluorescent lamp rated at 900 lumens was positioned atop a 17 inch monitor. The task area lit was a desk top providing a 36 inch by 18 inch workspace in front of the monitor. Several runs were conducted. The amount of light detected on the computer screen was at very low levels, ranging between about 1.5 foot candles to about 3 foot candles. Further adjustment of the visor revised the maximum foot candles on the screen to about 2.3 foot candles.

At the same time, the light at the indirectly lit task area was an absolute minimum of 3 foot candles at the edges of the 36 inch space being lit from the light source which was 6 inches in length. Generally, the light intensity increased more toward the center of the task area. For example, within approximately the central 18 inches of the task area, the illumination amounts measured at the same time as the computer screen measurements noted above ranged between about 8 foot candles and about 18 foot candles, discounting the fringes of this task area.

It will be understood that the embodiments of the present invention which have been described are illustrative of some of the applications of the principles of the present invention. Various modifications may be made by those skilled in the art without departing from the true spirit and scope of the invention.

What is claimed is:

1. A task light for mounting onto a computer component having a display screen, the task light comprising:

a housing which generally encloses an internal volume;

a light source which emits light rays from said internal volume, said housing having members for substantially preventing the light rays from exiting said internal volume except at a designated area;

a visor operatively positioned to be spaced from said designated area and in a direction at which said visor is impinged by at least some of the light rays exciting from said designated area, said visor having a forwardly projecting portion, said forwardly projecting portion extending genarally horizontally away from a vertical projection of said designated area so as to direct light rays from the light source to a task area in order to thereby provide indirect light to the task area while avoiding direct illumination of the task area; and a mounting component by which the task light is secured to the computer component.

2. The task light in accordance with claim 1, wherein said visor further includes a rearwardly projecting portion which is positioned generally vertically above said designated area, and said rearwardly projecting portion reflects light rays from the designated area to a location in front of the display screen of the computer component.

3. A task light for mounting onto a computer component having a display screen, the task light comprising:

a housing which generally encloses an internal volume;

a light source which emits light rays from said internal volume, said housing having members for substancially preventing the light rays from exiting said internal volume except at a designated area;

a visor operatively positioned to be spaced from said designated area and in a direction at which said visor is impinged by at least some of the light rays exiting from said designated area, said visor having a forwardly projecting portion, said forwardly projecting portion extending generally horizontally away from a vertical projection of said designated area so as to direct light rays from the light source to a task area in order to thereby provide indirect light to the task area while avoiding substancial illumination of the display screen of the computer component;

a mounting component by which the task light is secured to the computer component ; and wherein spacing is provided between said designated area and said visor such that others of said light rays do not impinge upon said visor in order to provide generally rearwardly and upwardly directed ambient light.

4. The task light in accordance with claim 1, wherein said mounting component includes a member for securing the task light to an upper surface of the computer component.

5. A task light for mounting onto a computer component having a display screen, the task light comprising:

a housing which generally encloses an internal volume;

a light source which emits light rays from said internal volume, said housing having members for substantially preventing the light rays from exiting said internal volume except at a designated area;

a visor operatively positioned to be spaced from said designated area and in a direction at which said visor is impinged by at least some of the light rays exiting from said designated area, said visor having a forwardly protecting portion, said forwardly protecting portion extending generally horizontally away from a vertical projection of said designated area so as to direct light rays from the light source to a task area in order to thereby provide indirect light to the task area while avoiding substantial illumination of the display screen of the computer component;

a mounting component by which the task light is secured to the computer component; and said mounting component is secured to said housing and is adjustable to tilt the housing with respect to the adjustable mounting component.

6. The task light in accordance with claim 5, wherein said adjustable mounting component includes components which slide relative to one another along an arcuate path.

7. A task light for mounting onto a computer component having a display screen, the task light comprising:

a housing which generally encloses an internal volume;

a light source which emits light rays from said internal volume, said housing having members for substantially preventing the light rays from exiting said internal volume except at a designated area;

a visor operatively positioned to be spaced from said designated area and in a direction at which said visor is impinged by at least some of the light rays exiting from said designated area, said visor having a forwardly protecting portion, said forwardly projecting portion extending generally horizontally away from a vertical projection of said designated area so as to direct light rays from the light source to a task area in order to thereby provide indirect light to the task area while avoiding substantial illumination of the display screen of the computer component;

a mounting component by which the task light is secured to the computer component; and a frame unit projects from said housing, and said visor is mounted to said frame unit so as to space said visor away from said housing in an upward direction.

8. The task light in accordance with claim 7, wherein said visor is adjustably mounted along said frame unit.

9. The task light in accordance with claim 8, wherein said visor is adjustable by tilting between a horizontal orientation and non-horizontal orientations.

10. The task light in accordance with claim 8, wherein said visor is adjustable vertically along at least a portion of said frame unit.

11. The task light in accordance with claim 1, further including a reflector within said housing and generally below said light source and said designated area.

12. The task light in accordance with claim 1, further including a reflector within said visor for receiving and reflecting light rays exiting from said designated area.

13. A task light for mounting onto a computer monitor, the task light comprising:

a base having a generally opaque external surface which generally encloses an internal volume, said base having a front and a back;

a generally transparent designated area of said base, which designated area is defined by an opening within said housing;

a light source within said base, said base substantially retards passage of light rays from the light source therethrough, and said designated area allows passage of said light rays therethrough;

a visor attached to the task light and at a location above said base, said visor having a forwardly projecting portion defining a forward light ray impingement area, said visor having a rearwardly projecting portion defining a rear light ray impingement area;

said rear impingement area being at a location generally vertically above at least a portion of said designated area;

said front impingement area being at a location generally vertically above and extending forwardly beyond said front of the base, and said visor deflects at least some of said light rays from the light source forwardly and downwardly to indirectly illuminate a task area generally forward of and generally below the front of said base and without directly illuminating said task area; and a mounting component for securing the task light to the computer monitor.

14. A task light for mounting onto a computer monitor, the task light comprising: a base having a generally opaque external surface which generally encloses an internal volume, said base having a front and a back;

a generally transparent designated area of said base, which designated area is defined by an opening within said housing;

a light source within said base, said base substantially retards passage of light rays from the light source therethrough, and said designated area allows passage of said light rays therethrough;

a visor attached to the task light and at a location above said base, said visor having a forwardly projecting portion defining a forward light ray impingement area, said visor having a rearwardly projecting portion defining a rear light ray impingement area;

said rear impingement area being at a location generally vertically above at least a portion of said designated area;

said front impingement area being at a location generally vertically above and extending forwardly beyond said front of the base, and said visor deflects at least some of said light rays from the light source forwardly and downwardly to indirectly illuminate a task area generally forward of and generally below the front of said base;

a mounting component for securing the task light to the computer monitor; and spacing is provided between said designated area and said visor such that others of said light rays do not impinge upon said visor in order to provide generally rearwardly and upwardly directed ambient light.

15. A task light for mounting onto a computer monitor,the task light comprising:

a base having a generally opaque external surface which generally encloses an internal volume, said base having a front and a back;

a generally transparent designated area of said base, which designated area is defined by an opening within said housing;

a light source within said base, said base substantially retards passage of light rays from the light source therethrough, and said designated area allows passage of said light rays therethrough;

a visor attached to the task light and at a location above said base, said visor having a forwardly projecting portion defining a forward light ray impingement area, said visor having a rearwardly projecting portion defining a rear light ray impingement area;

said rear impingement area being at a location generally vertically above at least a portion of said designated area;

said front impingement area being at a location generally vertically above and extending forwardly beyond said front of the base, and said visor deflects at least some of said light rays from the light source forwardly and downwardly to indirectly illuminate a task area generally forward of and generally below the front of said base;

a mounting component for securing the task light to the computer monitor; and a frame unit projects generally upwardly from said housing, said visor is mounted to said frame unit, and said visor is adjustable with respect to said frame unit.

16. The task light in accordance with claim 15, wherein said visor is adjustably mounted a long said frame unit.

17. A task light for mounting onto a computer monitor, the task light comprising:

a base having a generally opaque external surface which generally encloses an internal volume, said base having a front and a back;

a generally transparent designated area of said base, which designated area is defined by an opening within said housing;

a light source within said base, said base substantially retards passage of light rays from the light source therethrough, and said designated area allows passage of said light rays therethrough;

a visor attached to the task light and at a location above said base, said visor having a forwardly projecting portion defining a forward light ray impingement area, said visor having a rearwardly projecting portion defining a rear light ray impingement area;

said rear impingement area being at a location generally vertically above at least a portion of said designated area;

said front impingement area being at a location generally vertically above and extending forwardly beyond said front of the base, and said visor deflects at least some of said light rays from the light source forwardly and downwardly to indirectly illuminate a task area generally forward of and generally below the front of said base;

a mounting component for securing the task light to the computer monitor; and said mounting component is secured to said housing and is adjustable to tilt the housing with respect to the adjustable mounting component.

18. A task light for a computer monitor, comprising:

a housing which generally encloses an internal volume, said housing being at a location along a top portion of a computer monitor having a screen;

a light-passing opening associated with said housing;

a light source which emits light rays from said internal volume through said light-passing opening and to outside of said internal volume, said light rays leaving said light-passing opening in a generally upward orientation, said light rays being otherwise substantially confined within said internal volume;

a visor member located generally above said light-passing opening, said visor member being positioned to receive at least some of said light rays from the light source; and a forwardly projecting portion of said visor member which reflects said light rays generally downwardly in a ray tracing which extends substantially within a ray path defined by rays which are substantially parallel to and closely adjacent to the monitor screen and by rays directed at an acute angle with respect to said substantially parallel rays.

19. The task light in accordance with claim 18, wherein spacing is provided between said light-passing opening and said visor member such that others of said light rays do not impinge upon said visor member in order to provide generally rearwardly and upwardly directed ambient light.

20. The task light in accordance with claim 18, further including a mounting component for securing the task light to an upper panel of the computer monitor.

21. The task light in accordance with claim 20, wherein said mounting component is secured to said housing and is adjustable to tilt the housing with respect to the adjustable mounting component.

22. The task light in accordance with claim 18, further including a frame unit between said light-passing opening and said visor member, said visor member being mounted to said frame unit so as to space said visor member away from said light-passing opening in an upward direction.

23. The task light in accordance with claim 22, wherein said visor member is adjustably mounted along said frame unit.

24. The task light in accordance with claim 18, further including a reflector within said housing and generally below said light source.

25. A combined computer monitor and indirect illumination task light, comprising:

a computer monitor display screen of a computer component;

a light-passing opening which is positioned generally above said display screen;

a light source which transmits light rays generally upwardly through said light-passing opening;

a visor member located on the combined monitor and task light, said visor member being generally above said light-passing opening, said visor member being positioned to receive at least some of said light rays from the light source and which pass through said light-passing opening; and a reflective surface of said visor member which reflects at least some of said light rays generally downwardly in a ray pattern which provides indirect illumination of a task area generally in front of the computer component and which avoids direct illumination of said task area and of said display screen.

26. The combination in accordance with claim 25, wherein said light source is positioned within said computer monitor.

27. A combined computer monitor and indirect illumination task light, comprising:

a computer monitor display screen of a computer component;

a light-passing opening which is positioned generally above said display screen;

a light source which transmits light rays generally upwardly through said light-passing opening;

a visor member located generally above said light-passing opening, said visor member is mounted directly to said computer monitor, and said visor member is positioned to receive at least some of said light rays from the light source and which pass through said light-passing opening; and a reflective surface of said visor member which reflects at least some of said light rays generally downwardly in a ray pattern which avoids any substantial direct illumination of said display screen by said light rays and which provides indirect illumination of a task area generally in front of the computer component.

28. The combination in accordance with claim 25, further including a housing within which said light source is positioned and on which said light-passing opening is located, and said housing is positioned generally within said computer screen.

29. The combination in accordance with claim 25, further including a base assembly within which said light source is positioned and on which said light-passing opening is located, and said base assembly is secured to an upper surface of the computer monitor.

30. A combined computer monitor and indirect illumination task light, comprising:

a computer monitor display screen of a computer component;

a light-passing opening which is positioned generally above said display screen;

a light source which transmits light rays generally upwardly through said light-passing opening;

a visor member located generally above said light-passing opening, said visor member being positioned to receive at least some of said light rays from the light source and which pass through said light-passing opening;

a reflective surface of said visor member which reflects at least some of said light rays generally downwardly in a ray pattern which avoids any substantial direct illumination of said display screen by said light rays and which provides indirect illumination of a task area generally in front of the computer component; and a frame unit between said light-passing opening and said visor member, said visor member being mounted to said frame unit so as to space said visor member away from said light-passing opening in an upward direction.

31. The combination in accordance with claim 30, wherein said visor member is adjustably mounted along said frame unit.

32. The combination in accordance with claim 25, further including a reflector within said housing and generally below said light source.

33. A computer monitor having an indirect illumination task light, comprising:

a computer monitor having a case and a display screen with an upper portion of said case;

a light-passing opening which is located not lower than said upper portion of the display screen;

a light source which transmits light rays through said light-passing opening;

a visor member located on the computer monitor and above and generally vertically of said light-passing opening, said visor member being positioned to receive at least some of said light rays from the light source and which pass through said light-passing opening; and a portion of said visor member reflects said light rays generally downwardly in a ray pattern which excludes direct illumination by said light rays of said display screen and of a task area forward of the computer monitor, while providing indirect illumination of the task area.

34. The computer monitor in accordance with claim 33, wherein vertical spacing is provided between said light-passing opening and said visor member such that others of said light rays do not impinge upon said visor member in order to provide generally rearwardly and upwardly directed ambient light.

35. The computer monitor in accordance with claim 34, further including an ambient light passageway through said computer monitor case, and said ambient light passes through said ambient light passageway.

36. A computer monitor having an indirect illumination task light, comprising:

a computer monitor having a case and a display screen with an upper portion of said case;

a light-passing opening which is located not lower than said upper portion of the display screen;

a light source which transmits light rays through said light-passing opening;

a visor member located above and generally vertically of said light-passing opening, said visor member being positioned to receive at least some of said light rays from the light source and which pass through said light-passing opening;

a portion of said visor member reflects said light rays generally downwardly in a ray pattern which excludes direct illumination by said light rays of said display screen and of a task area forward of the computer monitor, while providing indirect illumination of the task area; and a frame unit between said light-passing opening and said visor member, said visor member being mounted to said frame unit so as to space said visor member away from said light-passing opening in an upward direction.

37. The computer monitor in accordance with claim 36, wherein said visor member is adjustably mounted along said frame unit.

38. The computer monitor in accordance with claim 33, further including a reflector within said housing and generally below said light source.

39. The computer monitor in accordance with claim 33, further including a housing within said computer monitor case, and said light source is located within said housing.

40. The computer monitor in accordance with claim 33, wherein said visor member reflects said light rays in said ray pattern which includes rays which are generally downwardly directed and substantially parallel to the display screen and rays which are generally downwardly directly and at an acute angle in a forward downwardly directed orientation.

* * * * *

UNITED STATES PATENT AND TRADEMARK OFFICE

CERTIFICATE OF CORRECTION

PATENT NO. : 6,089,724
DATED : July 18, 2000
INVENTOR(S) : Shore et al.

It is certified that error appears in the above-identified patent and that said Letters Patent is hereby corrected as shown below:

Title page, Item [54], and Column 1, line 1,
after "TASK LIGHT" insert -- FOR --.

Column 2,
Line 16, "CVs" should read -- CVS--.

Column 6,
Line 58, delete "exciting" and insert -- exiting --.
Line 61, delete "genarally" and insert -- generally --.

Column 7,
Line 11, delete "substancially" and insert -- substantially --.
Line 23, delete "substancial" and insert -- substantial --.

Signed and Sealed this

Twenty-sixth Day of March, 2002

*Attest:*

*Attesting Officer*

JAMES E. ROGAN
*Director of the United States Patent and Trademark Office*